United States Patent [19]

Defrancq et al.

[11] Patent Number: 4,723,763

[45] Date of Patent: Feb. 9, 1988

[54] DEVICE FOR CONTINUOUS INJECTION UNDER LOW PRESSURE OF A POWDERED ADDITIVE INTO A STREAM OF MOLTEN METAL

[75] Inventors: Charles-Emile-J. Defrancq, Zele, Belgium; Alain Ruckebusch, Triel/sur/Seine, France

[73] Assignee: Pechiney Electrometallurgie, Courbevoie, France

[21] Appl. No.: 919,042

[22] Filed: Oct. 15, 1986

[30] Foreign Application Priority Data

Oct. 15, 1985 [FR] France ..... 85 15609

[51] Int. Cl.[4] ..... C21C 7/02

[52] U.S. Cl. ..... 266/159; 75/53; 75/58; 75/93 R; 420/129; 420/590

[58] Field of Search ..... 75/53, 95 R, 58; 266/159; 420/129, 590

[56] References Cited

U.S. PATENT DOCUMENTS 2,803,533 8/1957 Bieniosek ..... 75/53
2,997,384 8/1961 Feichtinger ..... 75/93 R
2,997,386 8/1961 Feichtinger ..... 75/93 R
3,598,383 8/1971 Moore ..... 420/590

*Primary Examiner*—Peter D. Rosenberg
*Attorney, Agent, or Firm*—Dennison, Meserole, Pollack & Scheiner

[57] ABSTRACT

The invention relates to a device for continuous injection under low pressure of a powdered additive into a stream of molten metal.

It comprises, in succession from top to bottom:

a top compartment 5 for the admission of the molten metal, a treatment chamber 7 connected to the top compartment by a calibrated inlet orifice 8 and in which there opens, on the one hand, a tube 9 connected to a device for injection of powdered additive under gas pressure and, on the other hand, at least one conduit 11 for evacuation of gases, fumes and possible sullage, at least one buffer compartment 6 cooperating with a means for adjusting the discharge rate of the treated metal, a means for collecting the treated metal, for example a mould or a ladle.

16 Claims, 5 Drawing Figures

FIG. 5A
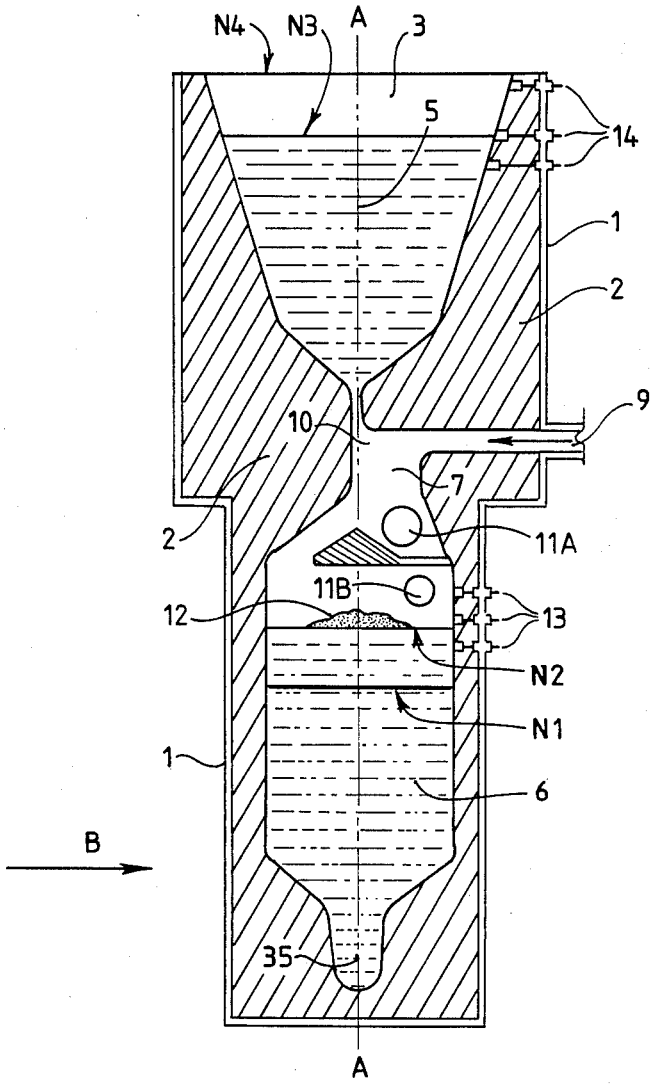
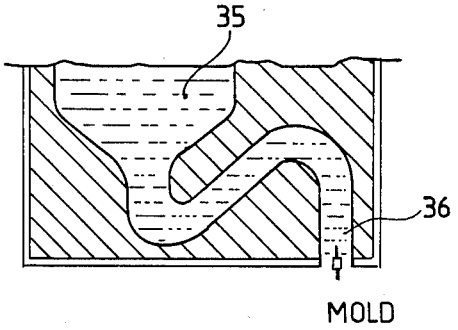
FIG. 5

DEVICE FOR CONTINUOUS INJECTION UNDER LOW PRESSURE OF A POWDERED ADDITIVE INTO A STREAM OF MOLTEN METAL

TECHNICAL FIELD OF THE INVENTION

The present invention relates to a device and a method for continuous injection, under low pressure and in the absence of air, of a powdered additive into a stream of molten metal. This powdered additive is directed by a carrier gas into the jet of molten metal, this gas possibly creating a protective atmosphere. The present invention applies, in particular, when the additive has to be added to the liquid metal in a small proportion, in a very homogeneous manner and, for example, immediately prior to casting.

STATE OF THE ART

It is known that powdered additives can be injected into a molten metal either for treatment of the metal such as deoxidisation or desulphurisation or change of structure, or for introducing an alloying element.

These injections are generally made by means of a lance immersed in a ladle containing the molten metal, the powdered additive being carried along by a stream of inert gas under sufficient pressure to counterbalance the hydrostatic pressure of the liquid metal. However, this method of injection is discontinuous.

If a stream of liquid metal is to be treated continuously, attempts are made to pour a controlled jet of powdered additive onto the cast jet of metal. This operation is awkward to carry out and is imprecise because, in practice, the jet of liquid metal and the jet of powdered additive tend to move relative to one another. Furthermore, a proportion, frequently large, of the additive does not penetrate the jet of metal, particularly, if the additive is very finely powdered. If, on the other hand, the additive is in coarse grains, it does not dissolve quickly enough. For example, when injecting an inoculant into the jet of liquid metal at the inlet of the mould in order to inoculate lamellar or nodular graphite cast iron the finest particles diffuse, leading to possible pollution of the moulding sand and flotation on the pouring cup of the mould.

Grains of inoculant which are too coarse are not dissolved fast enough and can carry inclusions into the articles.

To solve this problem, the so-called "cored wire" which is gradually unwound into the casting jet has been devised. However, this method cannot be adapted to all cases because it is more awkward than direct injection of powdered additive and is less flexible when using numerous additives of various types.

SUBJECT OF THE INVENTION

The present invention relates to a device for the continuous and controlled introduction into a stream of liquid metal of a predetermined proportion of powdered additive under pressure out of direct contact with the atmosphere and, if necessary, under a protective atmosphere with a yield of approximately 100% and always higher than 85%. The invention also relates to a method of introducing additives into a stream of liquid metal employing the above-mentioned device.

The device is characterized in that it comprises, in succession, from top to bottom:

a top compartment for the admission of molten metal, a treatment chamber connected to the top compartment by a calibrated inlet orifice and in which there merge on the one hand a tube connected to a device for injecting powdered additive under low gas pressure and, on the other hand, at least one conduit for evacuation of gases, fumes and possible drosses, at least one buffer compartment connected in its lower portion to a calibrated outlet orifice, possibly separated from said buffer compartment, a means for collecting the treated metal.

The method which employs the device according to the invention comprises the following successive stages:

molten metal is introduced into the top compartment while maintaining the level between an optimum level and a maximum level, the powdered additive is injected into the mixing chamber in a stream of carrier gas under low pressure and the speed of injection is adjusted so as to introduce a predetermined weight of additive per kg of metal to be treated, the level of molten metal in the lower compartment is maintained between the optimum level and the maximum level by acting on the introduction rate and on the level of molten metal in the top compartment, the molten metal treated is collected at the outlet of the lower orifice.

DESCRIPTION OF THE DRAWINGS

FIGS. 1 to 5 illustrate the invention.

FIG. 1 shows, in a vertical section, the actual device in which the additive is injected into the liquid metal.

FIG. 2 shows, in section, the assembly of an industrial apparatus also comprising a distributor-dispenser of powdered additive which does not itself form part of the invention but which is given as an example of implementation, FIG. 3 shows, in a vertical section, a variation of the actual device in which the device is placed directly on a casting mould.

FIG. 4 shows, in a vertical section, a variation of the actual device in which two successive injections of different powdered additives into the liquid metal can be carried out owing to the presence of two buffer compartments.

FIG. 5 shows, in a vertical section, a variation of the device in FIG. 1 (also applicable to FIGS. 3 and 4) in which a siphon compartment has been provided for completely retaining the residual sullage not evacuated through the orifice provided for this purpose.

The device, which has the general form of an egg timer comprises an external metallic casing 1 and an insulating and refractory internal lining 2 of which the nature is adapted to the metal (or alloy) to be treated. Hereinafter, any non-alloyed or alloyed molten metal product will be designated by "metal" and any powdered product (whatever its nature and its effects on the metal) injected into the metal by "additive". The term "powdered product" is taken here in the sense of a product in the form of more or less fine powder and/or small grains of which the size may be several millimeters, the limit being fixed by the possibility of carrying the product in a gas stream at low pressure.

Figure 1:
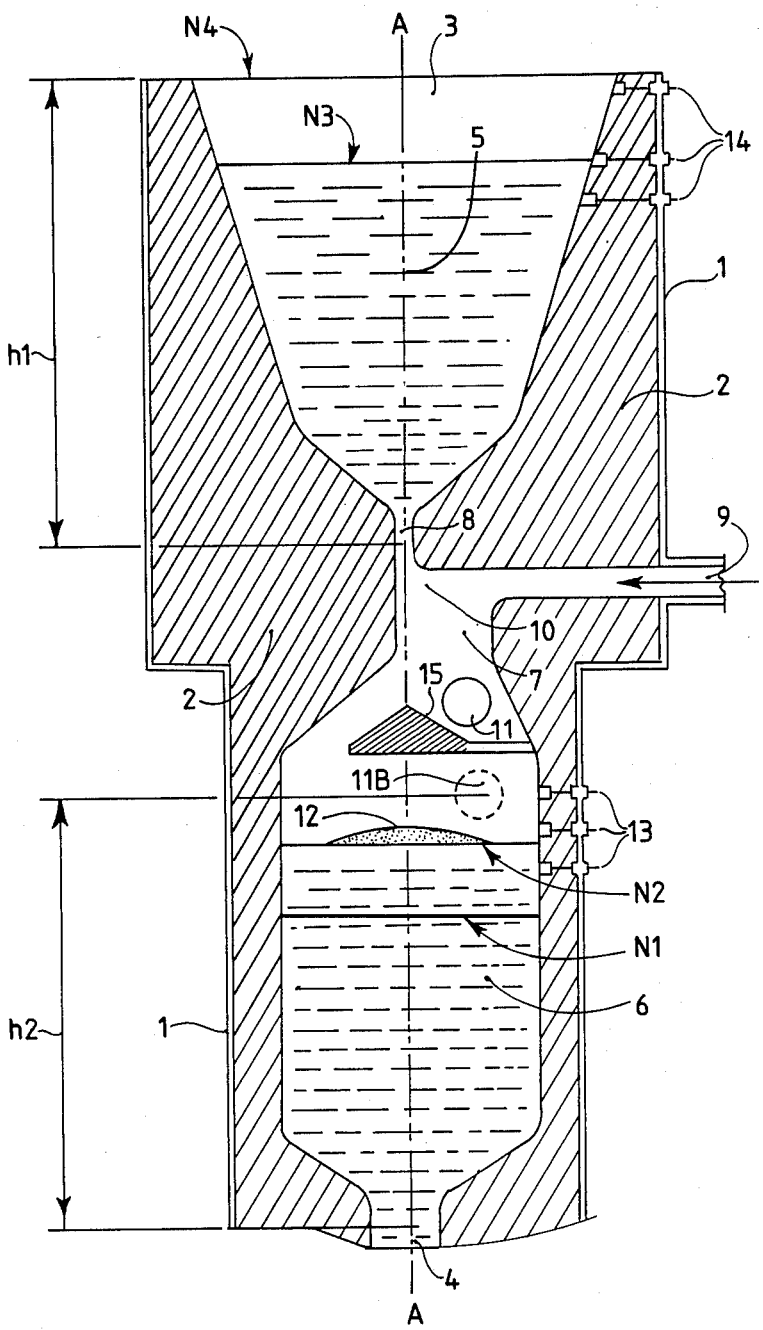

The device is provided at its top with an inlet 3 for the metal to be treated and at its bottom, in the case shown in FIG. 1, with a calibrated orifice 4 for the discharge of treated metal. It comprises three distinct but intercommunicating compartments: an upper compartment 5 in which there arrives the metal to be treated which originates either directly from a production furnace or from a holding furnace, or from an intermediate storage ladle, a buffer compartment 6 which opens with a calibrated orifice 4 into an intermediate storage container or into a casting ladle and finally, a treatment chamber 7 situated in the upper portion of the buffer compartment 6.

Figure 3:
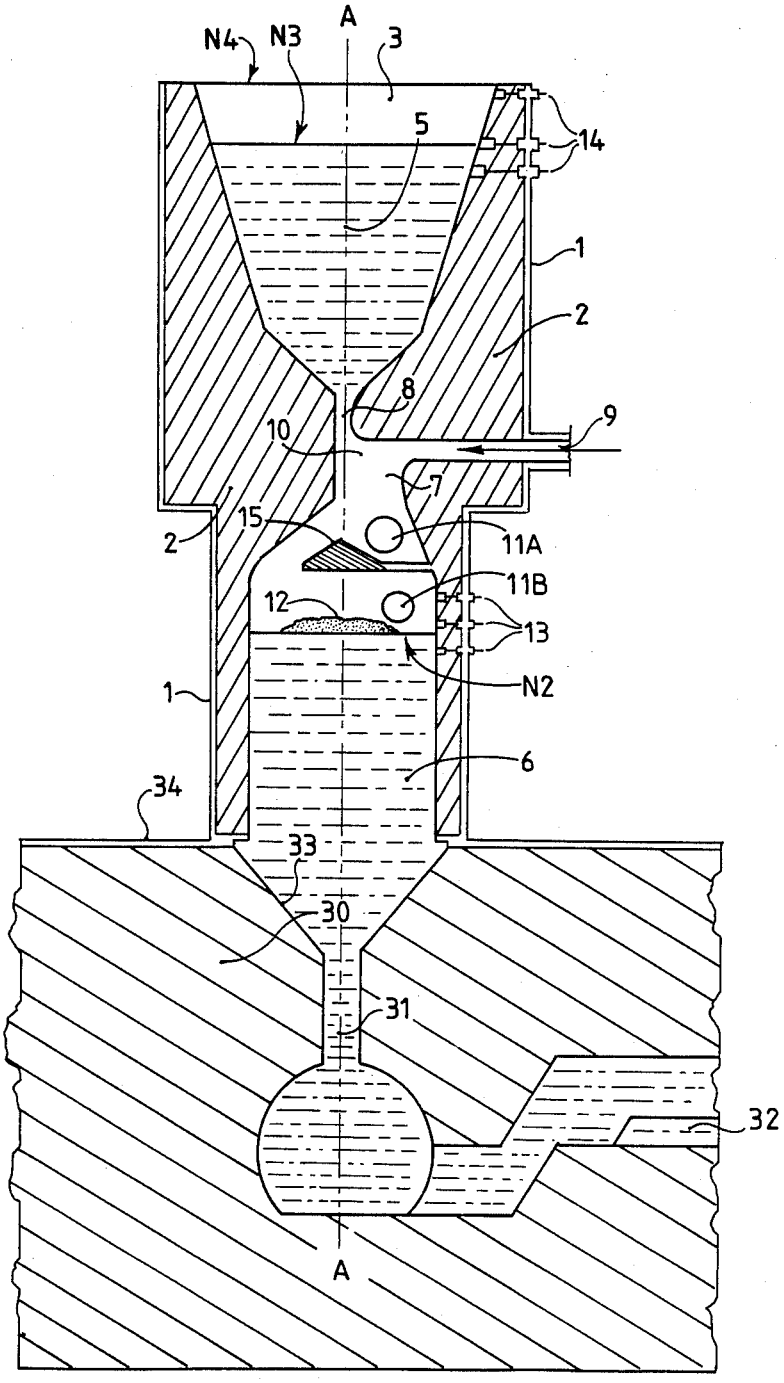

The treatment chamber 7 communicates with the inlet compartment 5 surmounting it with a calibrated inlet orifice 8 of which the function will be described below. The powdered additive is injected into the metal through the tube 9 in a stream of gas under pressure which breaks up on the layer of liquid metal flowing into the central region 10 of the treatment chamber. A lateral conduit 11 allows evacuation to the atmosphere of the protective gas and any reaction gases, fumes or sullage in such a way that the reaction chamber remains at a pressure slightly higher than atmospheric pressure. Two conduits 11, an upper conduit 11A for evacuation of gases, vapours and fumes, and a lower conduit 11B for the evacuation of sullage can also be provided (FIG. 3).

The stream of metal mixed with the powdered additive then flows into the buffer compartment 6 where dissolution of the additive and the reactions between the metal and the additive may be completed.

To allow this dissolution and these reactions the time to be completed and to allow separation of the sullage which may be formed, the cross section for passage of the outlet orifice 4 is determined, that is to say, in fact, the rate of discharge of the metal from the buffer compartment 6 in such a way that this compartment 6 remains constantly filled with liquid metal to a level which is approximately at least half way up and preferably approximately at least two-thirds of the way up (level N1) but without exceeding a maximum level N2 situated below the lower orifice 11B for evacuation of possible drosses.

This is a crucial point of the invention. In fact, by maintaining a reserve supply of metal in the buffer compartment 6, the mixing and the reaction between the additive and the metal are both ensured completely (therefore a useful yield of additive close to 100%) and the sullage 12 possibly formed has time to collect on the surface of the metal and then to be released through the orifice 11B if necessary.

To meet these conditions, it is necessary (a) to supply the top compartment 5 with metal to be treated at a speed which is such that a level close to the optimum level N3 and is relatively constant is maintained, (b) that there is between the cross-section for passage of the calibrated inlet orifice 8 and that of the calibrated orifice 4 a relationship which is such that the level of metal in the buffer compartment 6 is kept between fixed limits, taking into consideration the viscosity of the molten metal and the metallostatic pressure.

In the case shown in FIG. 1, when casting is completed, the compartment 6 empties completely so that the sullage is again located on the surface of the receiving ladle (not shown).

Figure 2:
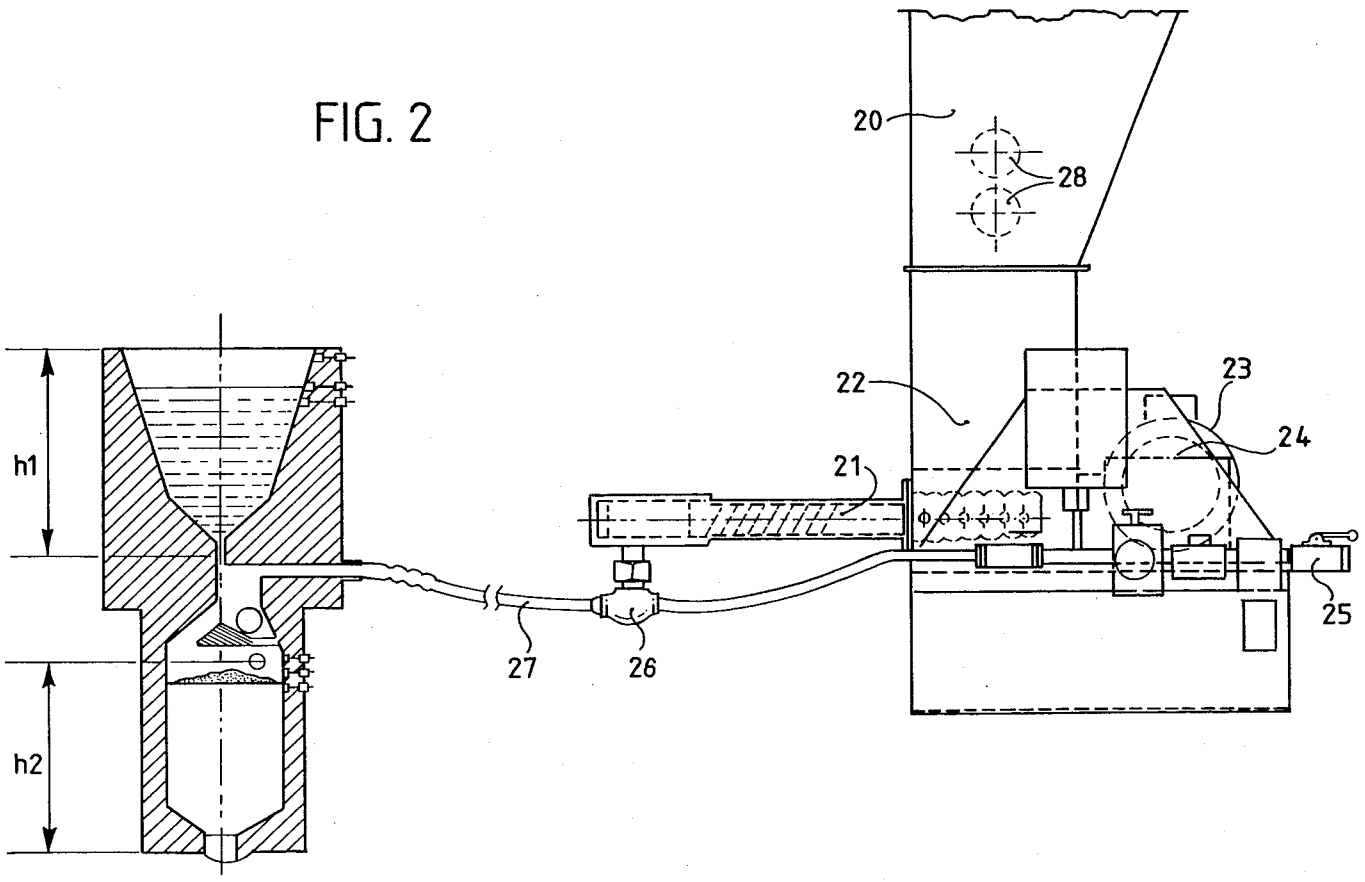

Powdered additive can be supplied in controlled manner by any means known to a person skilled in the art. FIG. 2 shows, schematically, a particularly well adapted device which essentially comprises a reservoir for powdered additive 20, a feed screw 21 traversing the lower portion 22 of the reservoir 20, a regulated and variable speed motor 23 allowing the screw 21 to be driven by means of a reduction gear 24, the powdered additive being supplied by the screw at a rate proportional to the speed of rotation, and a dried and de-oiled means 25 for the supply of compressed air or of neutral gas (for example nitrogen or argon) which allows the additive to be carried towards the injector 26 also acting as non-return device, then to the introduction pipe 9 supplied with gas under pressure through the tube 27. The reservoir 20 comprises two probes for measuring the level of powdered additive 28.

FIG. 3 shows, in a vertical section, a first variation of the invention according to which the device is placed directly on a casting mould 30 of which only the inlet is shown. The calibrated outlet orifice is no longer arranged at the base of the lower compartment: it is included in the mould and it is constituted by the smallest cross-section of the gate system (assembly of conduits bringing the metal from the mould inlet to the channels for supplying the impressions of the mould) and, for example, in the case illustrated, by the descent of charge 31 or by the gates 32 for the articles to be moulded.

In this case, once casting is completed, the compartment 6 empties completely in such a way that possible sullage is located on the surface of the mould cup without affecting the internal well-being of the articles.

Figure 4:
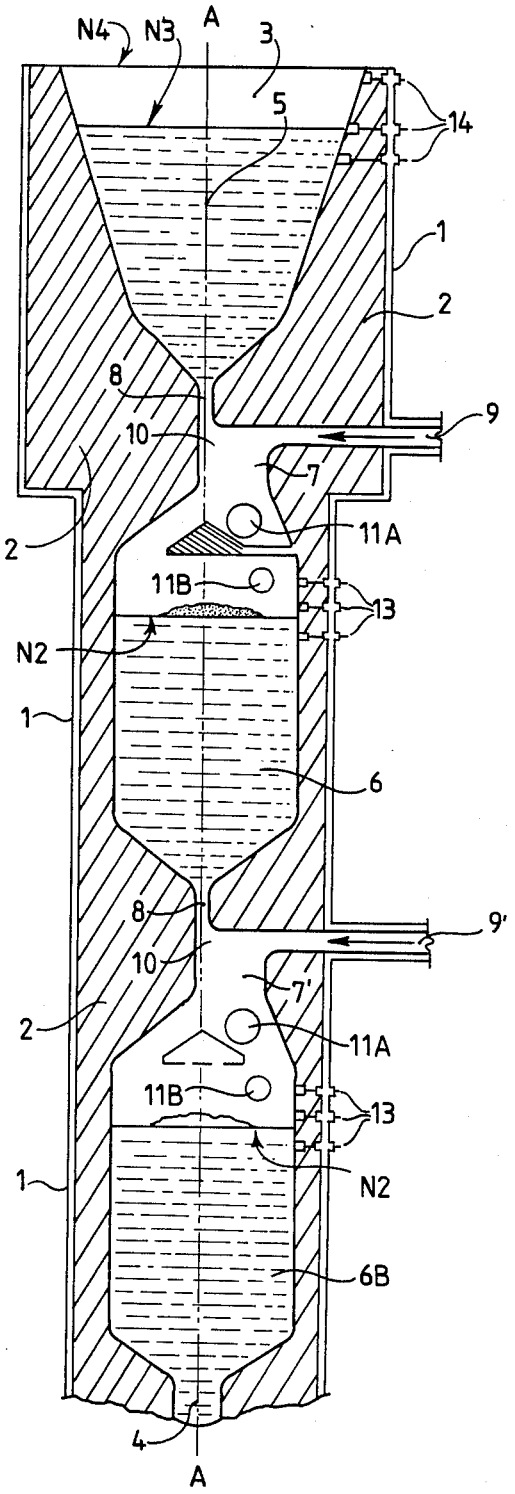

FIG. 4 shows, in a vertical section, a second variation according to which two successive injections of powdered additives into the liquid metal can be carried out by arranging two buffer compartments in series, an intermediate compartment 6A, and a lower compartment 6B, each having its own inlet 9, 9' for powdered additives, its orifices 11A and 11B for evacuation of the gases and sullage and its treatment chambers 7, 7' and its calibrated inlet orifices 8 and 8'.

FIG. 5 shows a third variation of the invention comprising the addition to the lower portion of the buffer compartment 6 of a siphon 35 enabling all the sullage not evacuated through the orifice 11B to be retained. The siphon can be adapted equally well to the case illustrated in FIG. 1 and, in this case, the calibrated orifice 4 arranged at the base of the buffer compartment 6 adjusts the speed of discharge of the metal whereas in FIG. 5 the buffer compartment 6 or 6B does not have a calibrated outlet orifice. This role is played by the outlet cross-section 36 of the siphon which is suitably calibrated for this purpose.

The level of metal in the lower compartment 6 can be measured, if necessary and regulated, as the case may be, by arranging a certain number of level probes 13 in the wall of this compartment and by regulating the speed of introduction of metal into the upper compartment. Furthermore, the flow rate of powdered additive can be regulated as a function of the flow rate of liquid metal penetrating the reaction chamber via the calibrated orifice 8 on the basis of the level measured in the top compartment 5 by means of probes 14 for example.

The drawing of the mixing chamber 7 is given as an embodiment and does not constitute a limitation to the invention. A person skilled in the art can optimise this drawing as a function of the nature of the metal treated (reactivity, viscosity) and the nature of the additive (powder in more or less fine, more or less reactive grains) so as to create, for example, turbulent effects or effects of dispersion of the metal stream, for example by adapting the shape of the orifice 8 or by interposing an obstacle such as 15 in this stream at the outlet of the orifice 8 or by any other equivalent means.

To facilitate maintenance and cleaning of the device, the device forming the subject of the invention can be produced in two parts, separated by a plane passing through the vertical axis AA and perpendicular to the powdered product inlet tube 9, which are kept in a connected and sealed relationship during casting by clamping collars or hydraulic jacks in known manner depending on the dimensions of the device.

EXAMPLES OF APPLICATION

Example 1

An experimental treatment device according to the invention was constructed in accordance with the diagram in FIG. 1 for nodulisation treatment of spheroidal graphite cast iron by addition of a ferrosilicomagnesium in small grains containing 5.7% of magnesium.

The inlet compartment 5 has the form of an inverted pyramid. The inlet cross-section is 250×250 mm and the height $h_1$ of the orifice 8 to the top of the inlet compartment 5 is 250 mm.

The orifice 8 has a cross section of 1200 $mm^2$ of rectangular shape 10×120 mm. The lower compartment is cylindrical with a diameter of 150 mm and a height $h_2$ of 270 mm between the calibrated outlet hole 4 and the orifice for evacuation of sullage 11B.

The outlet orifice 4 has a diameter of 40 mm, that is a cross-section for passage of 1257 $mm^2$ in comparison with the 1200 $mm^2$ of the orifice 8.

The ferrosilicomagnesium additive is injected through the tube 9 at a flow rate by weight of 90 g/second. The carrier gas used is nitrogen under a pressure of 0.06 MPa. The flow rate of liquid cast iron is 10 kg/second, corresponding to an addition of 0.9% by weight of FeSiMg to 5.7% of magnesium, that is 0.05 1% of added Mg. The device is supplied with liquid cast iron by an induction furnace, the treated cast iron being collected in a 500 kg receiving ladle placed beneath the treatment device. The magnesium incorporation yield, defined by the equation:

$$R = \frac{0.76\,(S\text{ base} - S\text{ treated cast iron}) + \text{residual Mg}}{\text{introduced Mg}}$$

is 87%.

Example 2

A second experimental treatment device according to the invention was constructed in accordance with the diagram in FIG. 3 in order to carry out the nodulisation treatment and inoculation of spheroidal graphite cast iron in a single operation.

This device is placed directly on a furanic sand mould. The total weight of the cast cluster is 55 kg. The cast article has a minimum thickness of 5 mm.

The inlet compartment 5 has the form of an inverted pyramid. The inlet cross-section is 250×250 mm and the height of the orifice up to the top of the inlet compartment 5 is 250 mm. The orifice 8 has a cross-sectional area of 600 $mm^2$ of rectangular shape 6×100 mm. The lower compartment is cylindrical with a diameter of 150 mm and a height of 220 mm between the setting plane 34 on the mould 30 and the sullage evacuation orifice 11B.

The rate of flow by weight into the mould is of the order of 5 kg/sec. This flow rate is adjusted by giving the channel for the descent of charge a calibrated cross-section.

The treatment product is a mixed product containing 95% of FeSiMg with 5.7% of magnesium and 5% of an inoculant ferrosilicon containing, among other things, 1% of bismuth and 0.5% of rare earths according to our French Pat. No. FR 2 511 044 (=U.S. Pat. No. 4,432,793). The mixed product having a granulometry of 0.2 to 1 mm is injected through the tube 9 at a flow rate, by weight, of 45 g/second, corresponding to 0.049% of added Mg. The cast iron treated in this way has the following final analysis:

C=3.74 Si=2.46 Mn=0.12 P=0.043 S=0.004 Mg=0.037

The cast article has a perfectly nodular structure in a die which is totally ferritic and free from carbides. The Mg incorporation yield is 85% in this case.

ADVANTAGES ACHIEVED BY THE INVENTION

In comparison with the systems used or known at present, the invention has the following advantages:

- additive incorporation yield close to 100%,
- addition rate of the additive is constant throughout casting, thus avoiding manual operations for weighing the liquid metal and the additive,
- possibility of using very fine particles of additives with an excellent yield and without risks of losses and of atmospheric pollution in the workshop and of the moulding sands.

The invention can also be applied to the simultaneous treatments of nodulisation and inoculation, as described in Example 2, for spheroidal graphite cast irons. The quantities of additives required for obtaining the correct characteristics for these cast irons are frequently 50% below conventional methods of nodulisation and inoculation in a ladle.

The method and the device can also be applied, in non-limiting manner:

- to the vermiculisation treatment of cast irons,
- to the recarburation treatment of cast irons,
- to the continuous desulphuration treatment of cast irons,
- to the desulphuration and denitriding treatment of steels,
- to microadditions in steels (such as boron) or in cast irons (such as vanadium, titanium . . . )
- to the various degassing and refining treatments for light alloys.

The arrangement of the apparatus allows the treated metal to be introduced immediately into the mould or moulds (FIG. 3) and this limits the risk of the effect of certain additives which are volatile, oxidisable or with transitory action (germination) from dying out.

Finally, the apparatus as just described with its different variations also allows the injection of a reactive gas or liquid with or without associated conveyance of powdered additive, for example for degassing aluminium by injection of a chlorine-nitrogen mixture.

What is claimed is:

1. A device for continuous injection of a powdered additive into a stream of molten metal, comprising:

(a) in vertical orientation (1) a top compartment 5 for admission of molten metal;

(2) a treatment chamber 7 located below said top compartment and being connected thereto by a calibrated inlet orifice 8, said treatment chamber having a tube 9 opening thereto which is connected to a device for injection of powdered additive under gas pressure, and conduit 11 opening thereto for evacuation of gases, fumes and possibly drosses; and (3) a buffer compartment 6 located below said treatment chamber and connected thereto, for collection and discharge of molten metal into which powdered additives have been injected;

(b) means for maintaining a substantially constant vertical level of molten metal in said buffer compartment by controlling inflow to and outflow from said buffer compartment, whereby complete mixing and reaction between the powdered additive and the molten metal is ensured; and (c) means for draining sullage from said buffer compartment separately from the discharge of molten metal.

2. A device according to claim 1, characterised in that it comprises two buffer compartments which are superimposed in series, an intermediate compartment 6A and a lower compartment 6B each comprising a treatment chamber 7, 7', a calibrated inlet orifice 8, 8' and at least one conduit for evacuation of gases, fumes and drosses.

3. A device according to claim 1 or 2, characterised in that the treatment chamber comprises two evacuation conduits, an upper conduit 11A for gases and fumes and a lower conduit 11B for the evacuation of drosses.

4. A device according to claim 1, characterised in that it comprises, at the base of the buffer compartment 6, a siphon 35 for retaining drosses.

5. A device according to claim 1 or 2, characterised in that the means for adjusting the discharge rate of the treated metal is constituted by a calibrated orifice arranged in the path of the treated metal.

6. A device according to claim 5, characterised in that the calibrated orifice 4 is arranged at the base of the buffer compartment 6.

7. A device according to claim 5, characterised in that the calibrated orifice is integrated with the means for collecting the treated metal.

8. A device according to claim 4, characterised in that a calibrated orifice is integrated with the siphon 35.

9. A device according to claim 1 or 2, characterised in that it comprises means for measuring the level of molten metal in the buffer compartment 6.

10. A device according to claim 9, characterised in that it comprises means for regulating the intake of molten metal into the top compartment 5 relative to the level of molten metal in the buffer compartment 6.

11. A device according to claim 1 or 2, characterised in that it is made up in two portions which are separated by a plane passing through the vertical axis perpendicular to the inlet orifice.

12. A device according to claim 2, additionally comprising a syphon 35 for retaining drosses at the base of the lower compartment 6B.

13. A device according to claim 5, wherein the calibrated orifice 4 is arranged at the base of the lower compartment 6B.

14. A device according to claim 1 or 2, additionally comprising means for measuring the level of molten metal in the top compartment 5.

15. A device according to claim 1 or 2, which is made up in two portions which are separated by a plane passing through the vertical axis perpendicular to the tube 9.

16. A device according to claim 1 or 2, wherein said means for draining sullage comprises an orifice in the buffer compartment.

* * * * *